US006671902B2

(12) United States Patent
Cheng

(10) Patent No.: US 6,671,902 B2
(45) Date of Patent: Jan. 6, 2004

(54) DETACHABLE SUPPORTING LEG FOR A BABY PLAYPEN

(76) Inventor: Kenny Cheng, No. 16, Lane 47, Chih Feng St., Taipei (TW)

( * ) Notice: Subject to any disclaimer, the term of this patent is extended or adjusted under 35 U.S.C. 154(b) by 0 days.

(21) Appl. No.: 09/997,566

(22) Filed: Nov. 29, 2001

(65) Prior Publication Data

US 2003/0097711 A1 May 29, 2003

(51) Int. Cl.[7] ..... A47C 19/12
(52) U.S. Cl. ..... 5/310; 5/99.1; 248/188
(58) Field of Search ..... 5/99.1, 310; 248/166, 248/188, 188.8

(56) References Cited

U.S. PATENT DOCUMENTS

| | | | | | |
|---|---|---|---|---|---|
| 5,211,498 | A | * | 5/1993 | Huang | 403/102 |
| 5,243,718 | A | | 9/1993 | Shamie | |
| 5,454,124 | A | * | 10/1995 | Huang | 5/99.1 |
| 5,474,404 | A | * | 12/1995 | Chien | 403/102 |
| 5,542,134 | A | * | 8/1996 | Wang | 5/99.1 |
| 5,615,427 | A | * | 4/1997 | Huang | 5/99.1 |
| 5,781,944 | A | | 7/1998 | Huang | |
| 5,956,786 | A | * | 9/1999 | Huang | 5/105 |
| 5,963,996 | A | * | 10/1999 | Hsia | 5/99.1 |
| 5,991,944 | A | * | 11/1999 | Yang | 5/99.1 |
| 6,058,528 | A | * | 5/2000 | Yang | 5/93.1 |
| 6,076,205 | A | * | 6/2000 | Yang | 5/99.1 |
| 6,430,762 | B1 | * | 8/2002 | Cheng | 5/93.2 |
| 6,467,107 | B1 | * | 10/2002 | Glover et al. | 5/99.1 |

FOREIGN PATENT DOCUMENTS

| | | |
|---|---|---|
| EP | 0295761 A2 | 12/1988 |
| GB | 2364911 A | 2/2002 |

* cited by examiner

*Primary Examiner*—Robert Sandy
*Assistant Examiner*—Thomas Ho
(74) *Attorney, Agent, or Firm*—Dorsey & Whitney LLP

(57) ABSTRACT

A detachable supporting leg for a baby playpen is disclosed. The supporting leg comprises a leg body and a coupling block releasably coupled with each other. The leg body has an upper coupling portion and a lower supporting portion integrally connected by a horizontal supporting wall. The coupling block is releasably coupled with the coupling portion of the leg body so as to be supported on the supporting wall. The coupling block is adapted to fixedly connect thereto an end portion of a vertical rod of the baby playpen and to pivotally connect thereto an end portion of a horizontal base rod of the baby playpen.

16 Claims, 4 Drawing Sheets

DETACHABLE SUPPORTING LEG FOR A BABY PLAYPEN

BACKGROUND OF THE INVENTION

1. Field of the Invention

This invention relates generally to a supporting leg for a baby playpen and, in particular, to a detachable supporting leg for a baby playpen, which allows easy detachment from and re-attachment to the baby playpen.

2. Description of the Prior Art

A conventional baby playpen normally includes four supporting legs at four lower corners thereof for stably supporting the playpen on the ground. A conventional supporting leg is an one-piece, unitary member and permanently connected to the baby playpen, Specifically, a supporting leg fixedly connects thereto a vertical rod of the playpen and pivotally connects thereto a horizontal base rod of the playpen. In order to reduce the package volume for transportation and hence the transportation cost, conventional baby playpens are generally foldable. When a baby playpen is to be folded for transportation, the horizontal base rod pivots with respect to the supporting leg towards the vertical rod in a plane defined by the horizontal base rod and the vertical rod. Since the vertical rod of the playpen is normally unfoldable, one of the three dimensions determining the volume occupied by the folded playpen is never less than the entire length of the vertical rod having the supporting leg connected thereto.

In view of the above, if the supporting leg can be detached from the playpen before the transportation, the package volume for transportation and hence the transportation cost for the playpen can be further reduced. Existing supporting legs, however, do not have a structure allowing easy detachment from and re-attachment to the baby playpen.

SUMMARY OF THE INVENTION

An object of the present invention is therefore to provide a detachable supporting leg for a baby playpen so that the package volume for transportation and hence the transportation cost for the baby playpen are reduced.

To achieve the above object, the present invention provides for a baby playpen a detachable supporting leg comprising a leg body and a coupling block releasably coupled with each other. The leg body has an upper coupling portion and a lower supporting portion integrally connected by a horizontal supporting wall. The coupling block is releasably coupled with the coupling portion of the leg body so as to be supported on the supporting wall. The coupling block is adapted to fixedly connect thereto an end portion of a vertical rod of the baby playpen and to pivotally connect thereto an end portion of a horizontal base rod of the baby playpen.

The above and other objects, features, aspects and advantages of the present invention will become apparent to those skilled in the art from the following detailed description, which, taken in conjunction with the accompanying drawings, discloses a preferred embodiment of the present invention.

DETAILED DESCRIPTION OF THE PREFERRED EMBODIMENT

A preferred embodiment of a detachable supporting leg for a baby playpen according to the present invention will be described in the following with reference to the accompanying drawings. Since the basic construction of a baby playpen is well known in the art, the following description will be directed in particular to elements or features of the baby playpen which are different from those of prior art, i.e., the detachable supporting leg and the connection thereof to the playpen according to the present invention. It is to be understood that elements or constructions of the playpen not specifically shown or described may take various forms well known to those skilled in the art.

Figure 1:
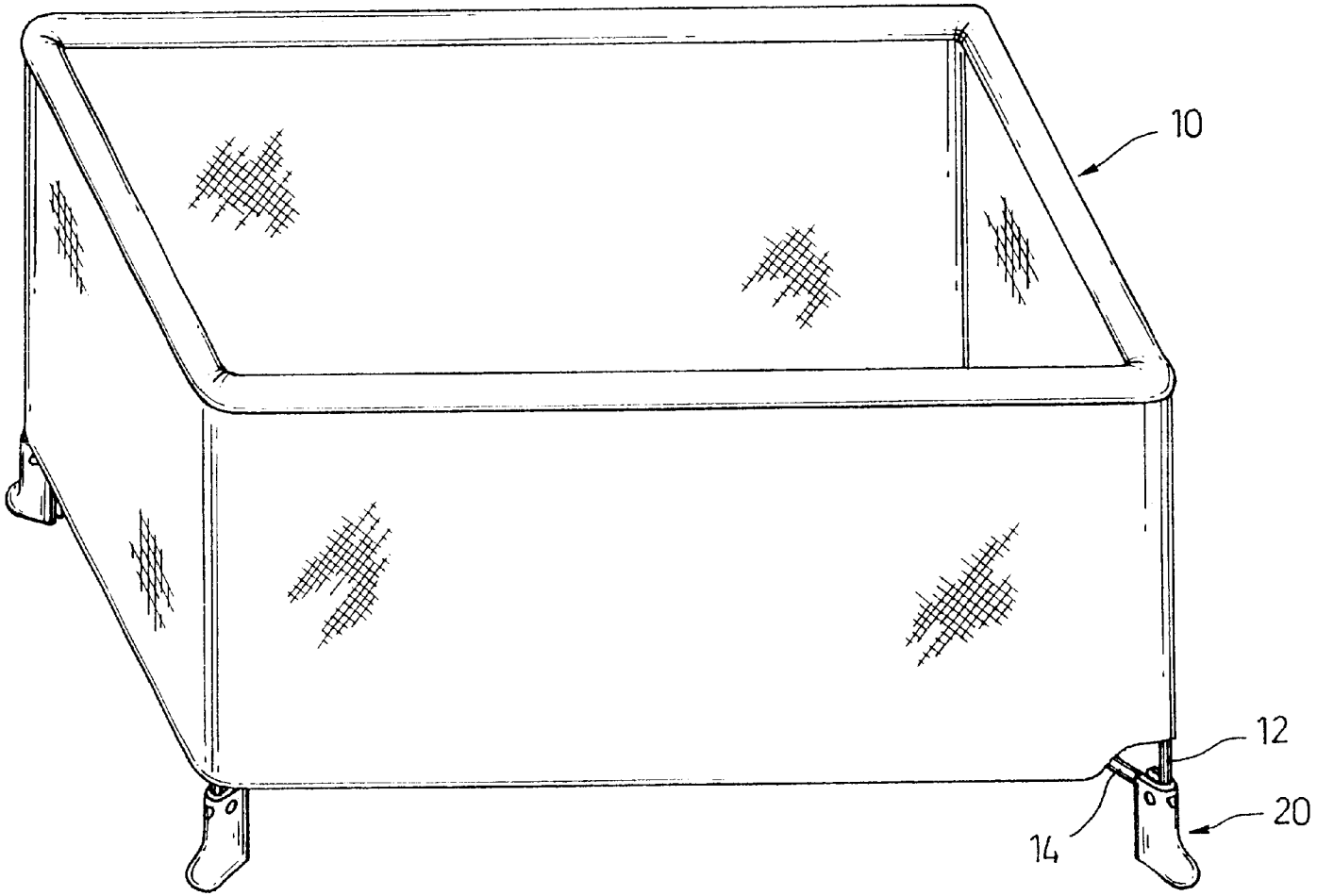
FIG. 1 is a perspective view showing a baby playpen having detachable supporting legs according to a preferred embodiment of the present invention.

FIG. 1 shows a baby playpen 10 having four detachable supporting legs 20 according to the preferred embodiment of the present invention. Each of the supporting legs 20 fixedly connects thereto a vertical rod 12 of the playpen 10. Each of the supporting legs 20 also pivotally connects thereto a diagonally-directed, horizontal base rod 14 of the playpen 10 so that, when the playpen 10 is to be folded for transportation, storage or the like, the horizontal base rod 14 pivots with respect to the supporting leg 20 towards the vertical rod 12 in a plane defined by the horizontal base rod 14 and the vertical rod 12. Since, except for the supporting leg 20, elements of the playpen 10, such as the vertical rod 10 and the horizontal base rod 14, are well known to those skilled in the art, the elements of the playpen 10 other than the supporting leg 20 will not be further discussed or illustrated in detail herein.

Figure 2:
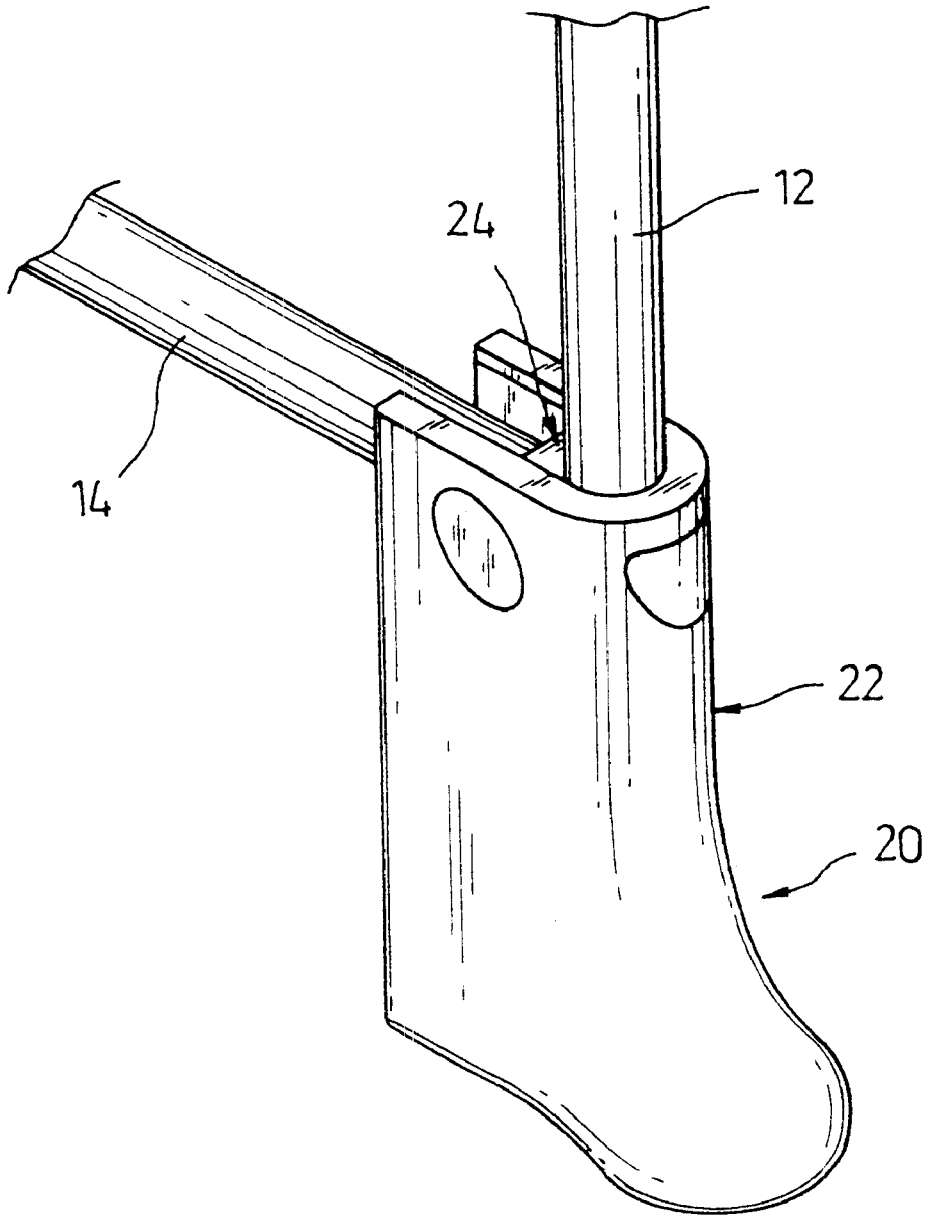
FIG. 2 is an enlarged perspective view of a detachable supporting leg according to the preferred embodiment of the present invention shown in FIG. 1, showing the supporting leg assembled with a vertical rod and a horizontal base rod of the playpen.
Figure 3:
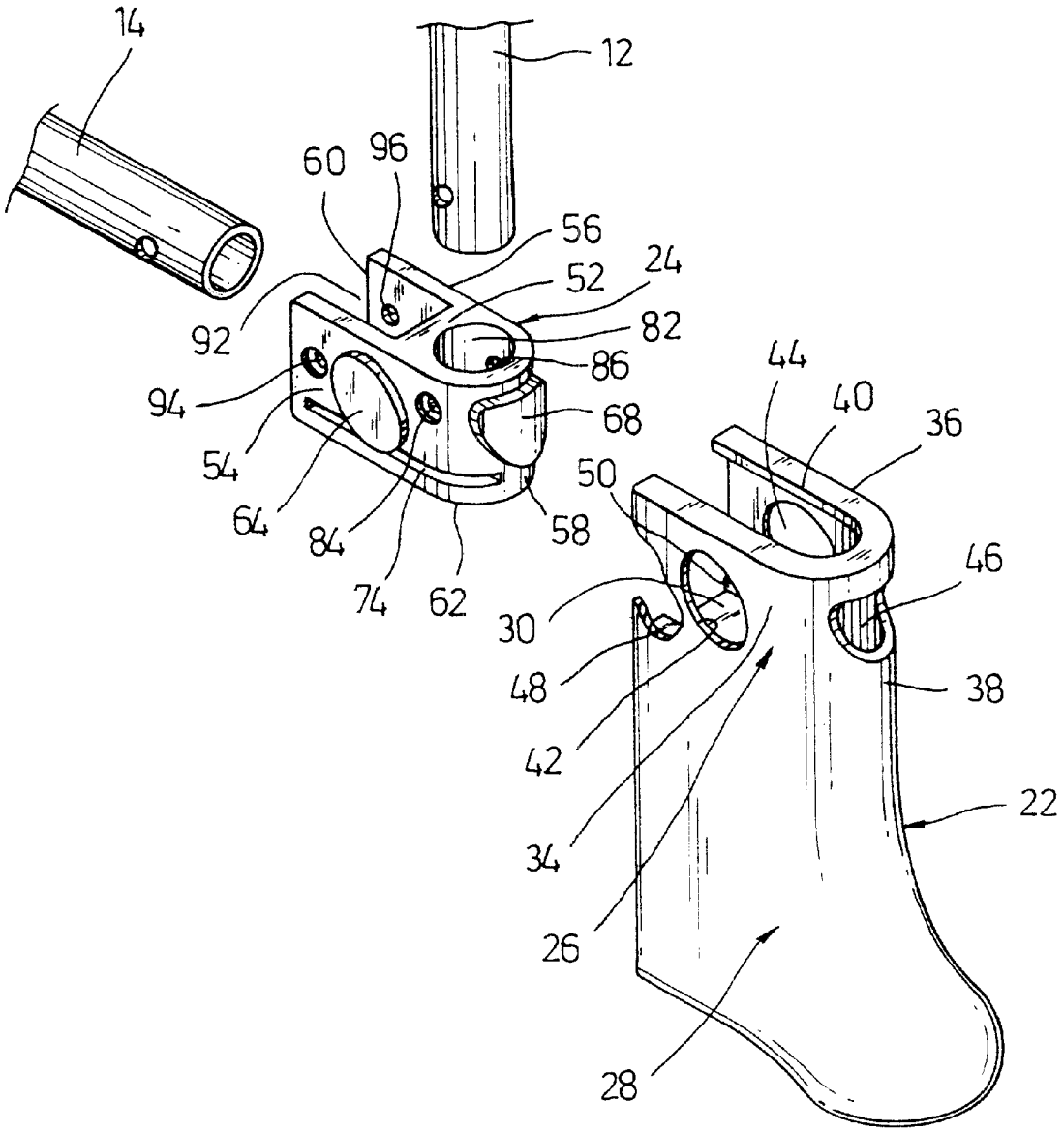
FIG. 3 is an exploded perspective view showing the supporting leg of FIGS. 1 and 2, a portion of a leg body of the supporting leg being broken away to show a rib.

FIG. 2 is an enlarged perspective view of the detachable supporting leg 20 shown in FIG. 1, showing the supporting leg 20 assembled with the vertical rod 12 and the horizontal base rod 14 of the playpen 10. FIG. 3 is an exploded perspective view of the supporting leg 20, FIG. 4 is a side view, partially in section, of the assembled supporting leg 20, and FIG. 5 is a sectional view taken alone the line V—V in FIG. 4.

As shown in FIGS. 2 and 3, the supporting leg 20 includes a leg body 22 and a coupling block 24 which can be coupled with and disengaged from each other. The coupling block 24 is adapted to fixedly connect thereto an end portion of the vertical rod 12 of the playpen 10 and to pivotally connect thereto an end portion of the horizontal base rod 14 of the playpen 10 as will be described in detail later. After the coupling block 24 is coupled with the leg body 22 (see FIG. 2), the playpen 10 can be supported on the ground via four leg bodies 22 at four lower corners thereof, as shown in FIG. 1.

Figure 4:
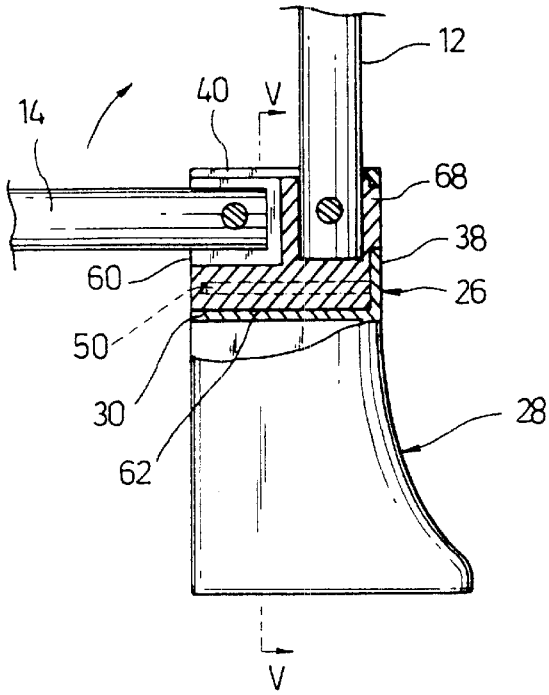
FIG. 4 is a side view, partially in section, showing the assembled state of the supporting leg of FIGS. 1 to 3.
Figure 5:
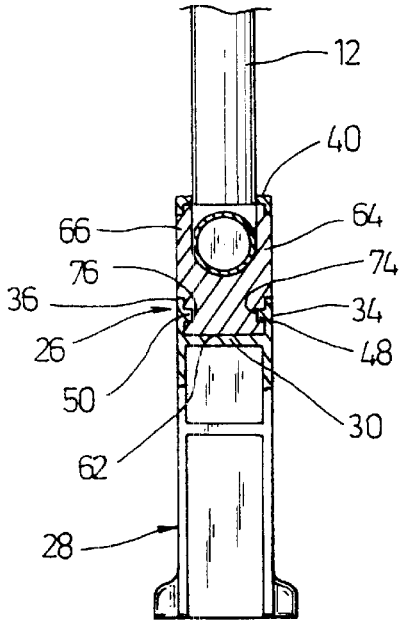
FIG. 5 is a sectional view taken alone the line V—V in FIG. 4.

As shown in FIGS. 3 to 5, the leg body 22 has an upper coupling portion 26, a lower supporting portion 28 and a horizontal supporting wall 30 integrally connecting the upper coupling portion 26 and the lower supporting portion 28. Since the detailed structure of the lower supporting portion 28 of the leg body 22 is not critical to the present invention as long as the playpen can be stably supported on the ground thereby after the coupling of the leg body 22 and the coupling block 24, the structure of the lower supporting portion 28 will not be further described or illustrated in detail herein.

In the preferred embodiment, the upper coupling portion 26 of the leg body 22 includes a vertical wall having a substantially U-shaped cross section and extending upwards integrally from the supporting wall 30. The vertical wall has a first wall portion 34, a second wall portion 36 parallel to the first wall portion 34, an end wall portion 38 integrally connected between the first wall portion 34 and the second wall portion 36 and an inwardly extending flange 40 integrally formed along an upper edge of the vertical wall.

The first wall portion 34 is formed with a first opening 42, and the second wall portion 36 is formed with a second opening 44 aligned with the first opening 42 of the first wall portion 34. The end wall portion 38 is formed with an end wall opening 46.

Of course, it will be apparent to those skilled in the art from this disclosure that the sizes, shapes and locations of the first opening 42, the second opening 44 and the end wall opening 46 are not limited to those shown in the figures herein but may be varied or modified as needed and/or desired, provided that the function which will described in detail later can be achieved thereby.

In the preferred embodiment, as shown in FIGS. 3 to 5, the coupling portion 26 of the leg body 22 also includes a first rib 48 and a second rib 50. The first rib 48 is located between the first opening 42 of the first wall portion 34 and the supporting wall 30. The first rib 48 protrudes from an inner surface of the first wall portion 34 towards the second wall portion 36 and extends parallel to the supporting wall 30. The second rib 50 is correspondingly located between the second opening 44 of the second wall portion 36 and the supporting wall 30. The second rib 50 protrudes from an inner surface of the second wall portion 36 towards the first wall portion 34 and extends parallel to the supporting wall 30. Preferably, as shown in FIG. 4, the second rib 50 is integrally connected at one end thereof with the end wall portion 38 and extends from the end wall portion 38 to a position near a free end surface of the second wall portion 36. Likewise, although not shown in the figures, the first rib 48 is integrally connected at one end thereof with the end wall portion 38 and extends from the end wall portion 38 to a position near a free end surface of the first wall portion 34.

As shown in FIG. 3, the coupling block 24 has a top surface 52, a first side surface 54, a second side surface 56, a first end surface 58, a second end surface 60 and a bottom surface 62. The coupling block 24 is sized such that a height between the top surface 52 and the bottom surface 62 corresponds to a distance between a lower surface of the flange 40 of the coupling portion 26 of the leg body 22 and an upper surface of the supporting wall 30 of the leg body 22, a width between the first side surface 54 and the second side surface 56 corresponds to a distance between the inner surface of the first wall portion 34 and the inner surface of the second wall portion 36 of the coupling portion 26 of the leg body 22 and a length between the first end surface 58 and the second end surface 60 corresponds to a distance between free end surfaces of the first wall portion 34 and the second wall portion 36 of the coupling portion 26 of the leg body 22. Thus, the coupling block 24 can be fittingly inserted into the space defined by the vertical wall of the coupling portion 26 and the supporting wall 30 of the leg body 22 such that the coupling block 24 is supported on the supporting wall 30 with the bottom surface 62 of the coupling block 24 abutting on the upper surface of the supporting wall 30 (see FIGS. 4 and 5). The second end surface 60 of the coupling block 24 is exposed between the free end surfaces of the first wall portion 34 and the second wall portion 36 of the coupling portion 26 when the coupling block 24 is completely inserted into the coupling portion 26 of the leg body 22.

In particular, in the preferred embodiment, as shown in FIGS. 3 and 5, the coupling block 24 is provided with a first protrusion 64 protruding from the first side surface 54 and a first groove 74 located between the first protrusion 64 and the bottom surface 62. The first groove 74 opens in the first end surface 58 and extends from the first end surface 58 to a position near the second end surface 60. The first protrusion 64 and the first groove 74 are respectively sized, shaped and positioned such that, when the coupling block 24 is completely inserted into the coupling portion 26 of the leg body 22, the first side surface 54 of the coupling block 24 abuts against the inner surface of the first wall portion 34 of the coupling portion 26 with the first protrusion 64 engaged in the first opening 42 of the first wall portion 34 and with the first groove 74 receiving the first rib 48 protruded from the first wall portion 34.

Likewise, as shown in FIG. 5, the coupling block 24 is also provided with a second protrusion 66 protruding from the second side surface 56 and a second groove 76 located between the second protrusion 66 and the bottom surface 62. The second groove 76 also opens in the first end surface 58 and extends from the first end surface 58 to a position near the second end surface 60. The second protrusion 66 and the second groove 76 are respectively sized, shaped and positioned such that, when the coupling block 24 is completely inserted into the coupling portion 26 of the leg body 22, the second side surface 56 of the coupling block 24 abuts against the inner surface of the second wall portion 36 of the coupling portion 26 with the second protrusion 66 engaged in the second opening 44 of the second wall portion 36 and with the second groove 76 receiving the second rib 50 protruded from the second wall portion 36.

The leg body 22 may be made from any resilient plastic material well known in the art such that the coupling block 24 provided with the protrusions 64 and 66 can elastically slightly deforms the first wall portion 34 and the second wall portion 36 so as to be inserted into the coupling portion 26.

Furthermore, as shown in FIG. 3, the coupling block 24 is provided with an end surface protrusion 68 protruding from the first end surface 58. The end surface protrusion 68 is sized, shaped and positioned such that, when the coupling block 24 is completely inserted into the coupling portion 26 of the leg body 22, the first end surface 58 of the coupling block 24 abuts against the inner surface of the end wall portion 38 of the coupling portion 26 with the end surface protrusion 68 engaged in the end wall opening 46 of the end wall portion 38.

When the coupling block 24 is inserted in the coupling portion 26 of the leg body 22, a portion (i.e., the peripheral portion) of the top surface 52 of the coupling block 24 abuts against the lower surface of the flange 40, while the remaining portion of the top surface 52 is exposed to the above (see FIG. 2). As shown in FIG. 3, the exposed surface portion of the top surface 52 of the coupling block 24 is formed with a vertical hole 82 near the first end surface 58 for receiving the end portion of the vertical rod 12 of the playpen 10 therein. For fixedly connecting the vertical rod 12 to the coupling block 24, a first countersunk hole 84 communicating with the vertical hole 82 is formed in the first side surface 54 of the coupling block 24, and a second countersunk hole 86 communicating with the vertical hole 82 is correspondingly formed in the second side surface 56 of the coupling block 24. Thus, the vertical rod 12 can be fixedly connected to the coupling block 24 after the vertical insertion of the end portion thereof into the vertical hole 82 of the coupling block 24 by means of countersunk fasteners such as countersunk rivets (not shown) passing through the first and second countersunk holes 84 and 86 and corresponding holes formed in the inserted end potion of the vertical rod 12.

Furthermore, as shown in FIG. 3, the exposed surface portion of the top surface 52 of the coupling block 24 is formed with a horizontal slot 92 for receiving the end portion of the horizontal base rod 14 of the playpen 10. The horizontal slot 92 extends from a position near the vertical hole 82 to the second end surface 60 of the coupling block 24 and opens in the second end surface 60. For pivotally connecting the horizontal base rod 14 to the coupling block 24, a third countersunk hole 94 communicating with the slot 92 is formed in the first side surface 54 of the coupling block 24, and a fourth countersunk hole 96 communicating with the slot 92 is correspondingly formed in the second side surface 56 of the coupling block 24. Thus, the horizontal base rod 14 can be pivotally connected to the coupling block 24 after the horizontal insertion of the end portion thereof into the slot 92 of the coupling block 24 by means of countersunk coupling elements such as countersunk bolts (not shown) passing through the third and fourth countersunk holes 94 and 96 and corresponding holes formed in the received end portion of the horizontal base rod 14. That is, with the provision of the slot 92, the horizontal base rod 14 can pivot with respect to the coupling block 24 towards the vertical rod 12 in a plane defined by the horizontal base rod 14 and the vertical rod 12 when the playpen 10 is being folded.

In the preferred embodiment, as shown in FIG. 3, the first protrusion 64 of the coupling block 24 is located between the first countersunk hole 84 and the third countersunk hole 94. Correspondingly, the second protrusion 66 of the coupling block 24 is located between the second countersunk hole 86 and the fourth countersunk hole 96. Of course, it will be apparent to those skilled in the art from this disclosure that the position relationship between the protrusions and the countersunk holes is not limited to the above but can have any other kind of arrangement provided that the aforementioned function is achieved.

With the structure of the detachable supporting leg 20 according to the preferred embodiment of the present invention described above, manufacturers of the baby playpen 10 can have the playpen 10 ready for transportation by fixedly connecting the vertical rod 12 and pivotally connecting the horizontal base rod 14 only to the coupling block 24 at each of the four lower corners and then folding the playpen 10 without any leg body 22. Since the playpen 10 does not have any leg body 22 attached in place, the height of the folded playpen 10 is reduced by an amount corresponding to the height of the lower supporting portion 28 of the leg body 22, thereby reducing the package volume for transportation and hence the transportation cost for the playpen 10. Consumers can easily attach the leg body 22 to the playpen 10 by simply inserting the coupling block 24 into the coupling portion 26 of the leg body 22. Then, the playpen 10 can be set up by following the general procedure well known in the art. Furthermore, the leg body can have various exterior patterns and/or colors and can be sold separately. Thus, consumers can freely select new leg bodies with desired exterior patterns and/or colors to replace old or damaged leg bodies.

It will be apparent to those skilled in the art from this disclosure that various modifications and changes may be made to the structure of the detachable supporting leg 20 according to the preferred embodiment of the present invention described above. For example, as long as the coupling block 24 is tightly coupled between the flange 40 and the supporting wall 30, the coupling potion 26 of the leg body 22 does not have to be provided with the openings 42, 44 and 46 and the ribs 48 and 50, and the coupling block 24 does not have to be provided with the protrusions 64, 66 and 68 and the grooves 74 and 76. Alternatively, the coupling portion 26 of the leg body 22 may be provided with the openings 42, 44 and 46 but not the ribs 48 and 50, and the coupling block 24 may be correspondingly provided with the protrusions 64, 66 and 68 but not the grooves 74 and 76. Still alternatively, the coupling portion 26 of the leg body 22 may be provided with the ribs 48 and 50 but not the openings 42, 44 and 46, and the coupling block 24 may be correspondingly provided with the grooves 74 and 76 but not the protrusions 64, 66 and 68. Furthermore, the number and shape of the openings and corresponding protrusions are not limited to those described and illustrated. For example, the end wall opening 46 and the end surface protrusion 68 may be eliminated.

Hence, while only one embodiment has been chosen to illustrate the present invention, it will be apparent to those skilled in the art from this disclosure that various changes and modifications can be made herein without departing from the scope of the invention as defined in the appended claims. Furthermore, the forgoing description of the preferred embodiment according to the present invention is provided for illustration only, and not for the purpose of limiting the invention as defined by the appended claims and their equivalents.

What is claimed is:

1. A supporting leg for a baby playpen, comprising:

a leg body having an upper coupling portion and a lower supporting portion integrally connected by a horizontal supporting wall, said coupling portion including a substantially U-shaped vertical wall extending upwards from said supporting wall, said vertical wall having a first wall portion, a second wall portion parallel to said first wall portion, an end wall portion integrally connected between said first wall portion and said second wall portion and an inwardly extending flange integrally formed along an upper edge of said vertical wall; and a coupling block inserted between said flange and said supporting wall so as to be releasably coupled with said coupling portion and supported on said supporting wall, said coupling block being adapted to fixedly connect thereto an end portion of a vertical rod of said baby playpen and to pivotally connect thereto an end portion of a horizontal base rod of said baby playpen, said coupling block comprising:

a bottom surface abutting on an upper surface of said supporting wall;

a first side surface abutting against an inner surface of said first wall portion;

a second side surface abutting against an inner surface of said second wall portion;

a first end surface abutting against an inner surface of said end wall portion;

a second end surface exposed between free end surfaces of said first wall portion and said second wall portion; and a top surface including a surface portion abutting against a lower surface of said flange and an exposed surface portion;

wherein a vertical hole is defined in said exposed surface portion of said top surface near said first end surface; a first countersunk hole is defined in said first side surface so as to communicate with said vertical hole; and a second countersunk hole is defined in said second side surface so as to communicate with said vertical hole; whereby said end portion of said vertical rod of said baby playpen is inserted into said vertical hole so as to be fixedly connected to said coupling block; and wherein a horizontal slot is defined in said exposed surface portion of said top surface and extending from said second end surface to a vicinity of said vertical hole; a third countersunk hole is defined in said first side surface so as to communicate with said slot; and a fourth countersunk hole is defined in said second side surface so as to communicate with said slot; whereby said end portion of said horizontal base rod of said baby playpen is received in said slot so as to be pivotally connected to said coupling block.

2. A supporting leg according to claim 1 wherein said first wall portion is formed with a first opening therein, said second wall portion is formed with a second opening therein, said first side surface is provided thereon with a first projection to be engaged in said first opening and said second side surface is provided thereon with a second projection to be engaged in said second opening.

3. A supporting leg according to claim 2 wherein said first projection is located between said first and third countersunk holes and said second projection is located between said second and fourth countersunk holes.

4. A supporting leg according to claim 2 wherein said end wall portion is formed with an end wall opening therein and said first end surface is provided thereon with an end surface projection to be engaged in said end wall opening.

5. A supporting leg according to claim 4 wherein said first projection is located between said first and third countersunk holes and said second projection is located between said second and fourth countersunk holes.

6. A supporting leg according to claim 2 wherein said first wall portion is provided with a first rib protruding therefrom towards said second wall portion and extending parallel to said supporting wall, said second wall portion is provided with a second rib protruding therefrom towards said first wall portion and extending parallel to said supporting wall, said first side surface is formed therein with a first groove for receiving said first rib and said second side surface is formed therein with a second groove for receiving said second rib.

7. A supporting leg according to claim 6 wherein said first rib is located between said first opening and said supporting wall, said second rib is located between said second opening and said supporting wall, said first groove is located between said first projection and said bottom surface and said second groove is located between said second projection and said bottom surface.

8. A supporting leg according to claim 7 wherein said first projection is located between said first and third countersunk holes and said second projection is located between said second and fourth countersunk holes.

9. A supporting leg according to claim 7 wherein said end wall portion is formed with an end wall opening therein and said first end surface is provided thereon with an end surface projection to be engaged in said end wall opening.

10. A supporting leg according to claim 9 wherein said first projection is located between said first and third countersunk holes and said second projection is located between said second and fourth countersunk holes.

11. A supporting leg according to claim 6 wherein said first projection is located between said first and third countersunk holes and said second projection is located between said second and fourth countersunk holes.

12. A supporting leg according to claim 6 wherein said end wall portion is formed with an end wall opening therein and said first end surface is provided thereon with an end surface projection to be engaged in said end wall opening.

13. A supporting leg according to claim 12 wherein said first projection is located between said first and third countersunk holes and said second projection is located between said second and fourth countersunk holes.

14. A supporting leg according to claim 1 wherein said first wall portion is provided with a first rib protruding therefrom towards said second wall portion and extending parallel to said supporting wall, said second wall portion is provided with a second rib protruding therefrom towards said first wall portion and extending parallel to said supporting wall, said first side surface is formed therein with a first groove for receiving said first rib and said second side surface is formed therein with a second groove for receiving said second rib.

15. A supporting leg according to claim 14 wherein said first groove is located between said first and third countersunk holes and said bottom surface and said second groove is located between said second and fourth countersunk holes and said bottom surface.

16. A supporting leg according to claim 14 wherein said end wall portion is formed with an end wall opening therein and said first end surface is provided thereon with an end surface projection to be engaged in said end wall opening.

* * * * *